US008919076B1

(12) United States Patent
Kitchens

(10) Patent No.: US 8,919,076 B1
(45) Date of Patent: Dec. 30, 2014

(54) ADJUSTABLE TILE SPACER

(71) Applicant: Christopher S. Kitchens, Castle Rock, CO (US)

(72) Inventor: Christopher S. Kitchens, Castle Rock, CO (US)

( * ) Notice: Subject to any disclaimer, the term of this patent is extended or adjusted under 35 U.S.C. 154(b) by 0 days.

(21) Appl. No.: 13/935,080

(22) Filed: Jul. 3, 2013

(51) Int. Cl.
*E04F 21/20* (2006.01)
*E04F 21/00* (2006.01)
*E04F 15/02* (2006.01)

(52) U.S. Cl.
CPC ..... *E04F 21/0092* (2013.01); *E04F 15/0215* (2013.01); *Y10S 33/20* (2013.01)
USPC ... 52/747.11; 52/749.11; 33/527; 33/DIG. 20

(58) Field of Classification Search
CPC ..... Y10S 33/20; E04F 21/22; E04F 21/0092; E04F 13/0862; E04F 13/0892
USPC ..... 52/749.11, 747.11; 33/527, 464, 469, 33/470, DIG. 20
See application file for complete search history.

(56) References Cited

U.S. PATENT DOCUMENTS

| | | | | |
|---|---|---|---|---|
| 1,941,404 | A | 12/1933 | Lansing | |
| 2,881,532 | A | 4/1959 | Boykin | |
| 3,718,980 | A * | 3/1973 | Poulos | 33/526 |
| 3,744,141 | A | 7/1973 | Strickland | |
| 4,656,753 | A | 4/1987 | Chesworth | |
| 4,860,518 | A | 8/1989 | Kingham | |
| 5,038,490 | A | 8/1991 | Armstrong | |
| 5,181,326 | A | 1/1993 | Eberline | |
| 5,263,260 | A | 11/1993 | Smith | |
| 5,293,694 | A * | 3/1994 | Swindle | 33/527 |
| 5,471,758 | A | 12/1995 | White | |
| 5,537,805 | A | 7/1996 | Allman | |
| 5,701,680 | A * | 12/1997 | Garcia et al. | 33/526 |
| 5,768,793 | A * | 6/1998 | Fields | 33/526 |
| 5,832,619 | A * | 11/1998 | Volkema, Jr. | 33/527 |
| 6,049,990 | A * | 4/2000 | Holland | 33/464 |
| 6,195,904 | B1 * | 3/2001 | Greer | 33/527 |
| 6,796,049 | B1 | 9/2004 | Claxton | |
| 7,111,435 | B2 | 9/2006 | Flores | |
| 7,254,920 | B2 | 8/2007 | Steele | |
| 7,748,132 | B1 * | 7/2010 | Engala | 33/527 |
| 7,841,095 | B1 * | 11/2010 | Board | 33/470 |
| 8,708,310 | B2 * | 4/2014 | Edgerly | 254/11 |

FOREIGN PATENT DOCUMENTS

| | | | | |
|---|---|---|---|---|
| GB | 635896 A * | 4/1950 | | E04B 2/86 |

* cited by examiner

*Primary Examiner* — Brent W Herring
(74) *Attorney, Agent, or Firm* — Blakely Sokoloff Taylor & Zafman LLP

(57) ABSTRACT

An adjustable tile spacer is described. In one example, the tile spacer includes a first support bar connected to a first spacer arm. The first spacer arm has a top face to abut a wall and support a tile. A second support bar is movably connected to the first support bar. A second spacer arm is connected the second support bar. The first spacer arm has a bottom face to abut a wall and to support the second support bar against a tile. A lock fixes the first and the second support bars in a position with respect to each other when the lock is engaged to define a distance between the top face and the bottom face corresponding to a gap between two tiles.

20 Claims, 8 Drawing Sheets

ADJUSTABLE TILE SPACER

FIELD

The present description relates to tile spacers for tile installation and, in particular, to a bracket with an adjustable amount of spacing.

BACKGROUND

In laying tile, spacers are used between each tile to separate the tiles by a consistent distance determined by the size of the spacers. The tiles are placed on mortar or another adhesive to attach the tiles to the underlying surface. After the mortar is cured or dried sufficient to hold the tiles in place, then the spacers are removed. The gaps between each tile are then filled with grout.

For a wall, the bottom row of tiles rests on a surface, typically the floor or rim of a tub, however, other types of supports may be used. The second row of tiles rests on the bottom row of tiles or on spacers that rest on the bottom row of tiles. Rows of tiles are stacked on top of each other up to the top row.

For some types of wall designs, decorative patterns are used that are not able to support the weight of additional rows of tiles above the pattern. Some such decorative patterns have stone or tile pieces with uneven size or spacing attached to a mesh backing. In order to install such a decorative pattern, the pattern is applied onto the wall with mortar or adhesive, then the tile rows above the pattern are applied after the mortar for the decorative pattern has dried. This prevents the tiles above from disturbing the pattern. Grout can then be applied after all of the mortar has dried.

SUMMARY

An adjustable tile spacer is described. In one example, the tile spacer includes a first support bar connected to a first spacer arm. The first spacer arm has a top face to abut a wall and support a tile. A second support bar is movably connected to the first support bar. A second spacer arm is connected the second support bar. The first spacer arm has a bottom face to abut a wall and to support the second support bar against a tile. A lock fixes the first and the second support bars in a position with respect to each other when the lock is engaged to define a distance between the top face and the bottom face corresponding to a gap between two tiles.

BRIEF DESCRIPTION OF THE DRAWINGS

The invention may best be understood by referring to the following description and accompanying drawings that are used to illustrate embodiments of the invention. In the drawings.

DETAILED DESCRIPTION

Figure 1:
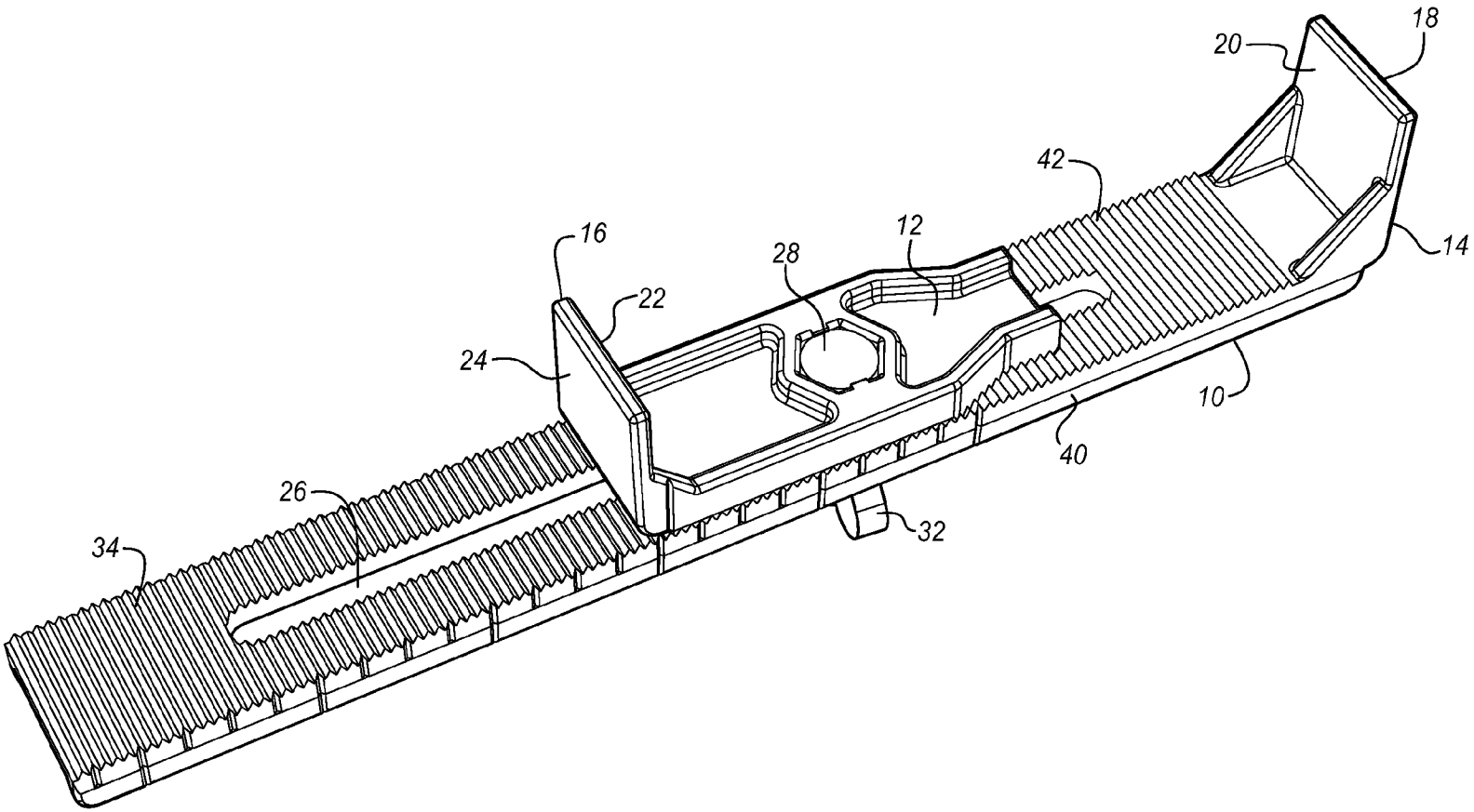
FIG. 1 is a perspective view diagram of an adjustable tile spacer according to an embodiment of the invention.

FIG. 1 is a perspective view diagram of an adjustable tile spacer. The spacer has two support bars 10 and 12 each support bar has an arm 14, 16 that extends perpendicular to the support bar. The first support bar 10 for example has an arm 14 that extends out to include a top face 18 and a bottom face 20. The top face is designed to abut a wall, for example a wall with thinset adhesive, mortar, or some other tile adhering material on it. The top face is designed to have a flat surface upon which a row of tiles can rest.

Similarly the spacer arm of the second support bar 16 also has a top surface 22 and a bottom surface 24 for the spacer arm. The spacer arms are both designed to extend out the same distance so that the ends will contact the same vertical wall while the support bars are level with the wall along their length.

The support bars are parallel to each other and the spacer arms extend perpendicular to the support bars so that they are also parallel to each other. The spacer arms may have various reinforcements, braces, ribs, and brackets depending on the particular implementation. The larger first support bar 10 includes an elongated groove 26 that goes most of the length of the elongated support bar through the center of the bar. The second support bar has a bolt 28 that extends through the groove 26 to allow the second support bar to slide along the groove to a variety of different positions.

A nut 32, such as a wing nut, on the opposite side of the first support bar screws into the bolt 28 to hold the second support bar in any desired position along the length of the groove 26. While a wing nut is shown any type of hand fastening system may be used, including lever operated clamps. Alternatively, a convention hex nut or other fastener may be used so that a tool is required to fix the first and second support bars in position.

Moving the support bars with respect to each other along the length of elongation moves the two support arms with respect to each other. This allows the distance from the top face 18 of the first support arm 14 to be adjusted relative to the bottom face 24 of the second support arm 16. This distance can be used to determine the distance from between one row of tiles laid on a vertical wall and an upper row of tiles laid on the same vertical wall. The adjustable tile spacer also has a textured surface 34 on each support bar that helps to prevent the two support bars from moving after the nut 32 has been tightened to hold the two support bars in place.

The larger first support bar may have a ridge (not shown) on either side of its inner face along the length of the support bar to act as a guide for the smaller second support bar. The ridges may be used as guides to control the lateral movement of the support bars. The second support bar would rest between the two ridges as it slides along the groove in the first support bar. The ridges may be on the edge or in any other position and aligned with longitudinal guides on the second support bar. The ridges are an optional feature and the groove and bolt 28 may also or alternatively be relied upon to hold the smaller second support bar in place.

Figure 2:
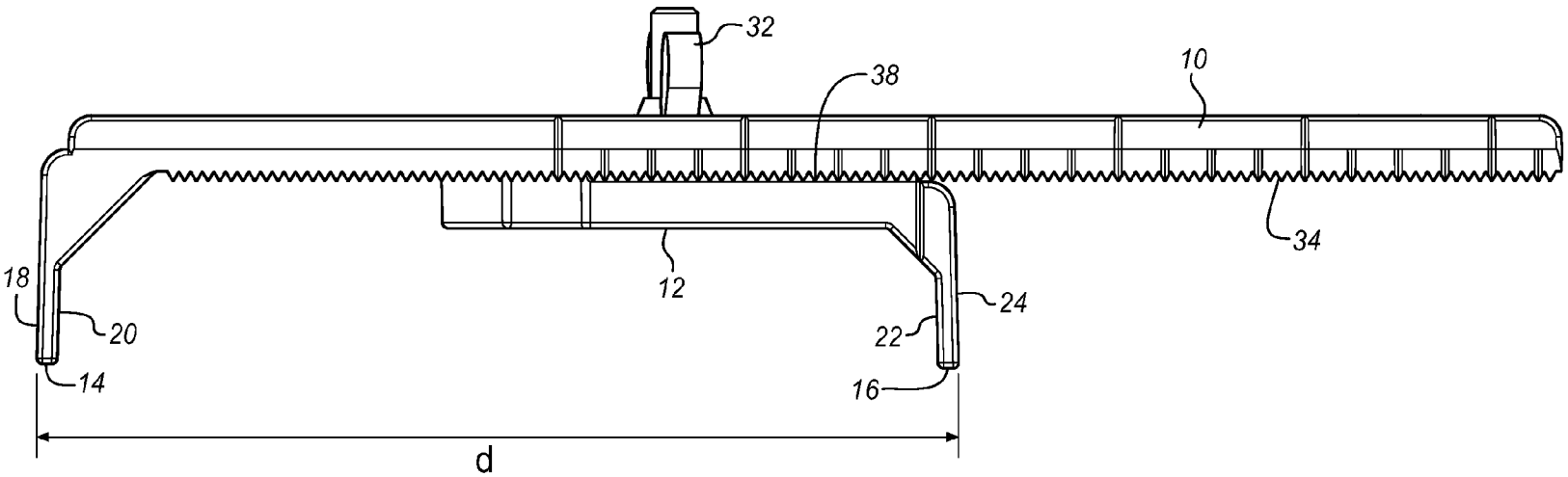
FIG. 2 is a side elevation view of the adjustable tile spacer of FIG. 1 according to an embodiment of the invention.

FIG. 2 is a side elevation view of the adjustable tile spacer of FIG. 1. As shown, the distance (d) from the top face 18 of the larger first support bar to the bottom face 24 of the smaller second support bar is determined by moving the second support bar from left to right as shown in the figure with respect to the larger first support bar 10. This distance (d) determines the distance between two rows of tiles and is adjusted before use. Once selected, the distance can be fixed and locked by turning and fastening the wing nut 32. The textured surface 34 of both the first 10 and second 14 support bars is a series of ridges. The ridges of the first support bar 34 engage the ridges 38 of the second support bar to hold the two support bars in position relative to each other even as weight is applied on one or the other of the arms of the adjustable tile spacer.

Figure 3:
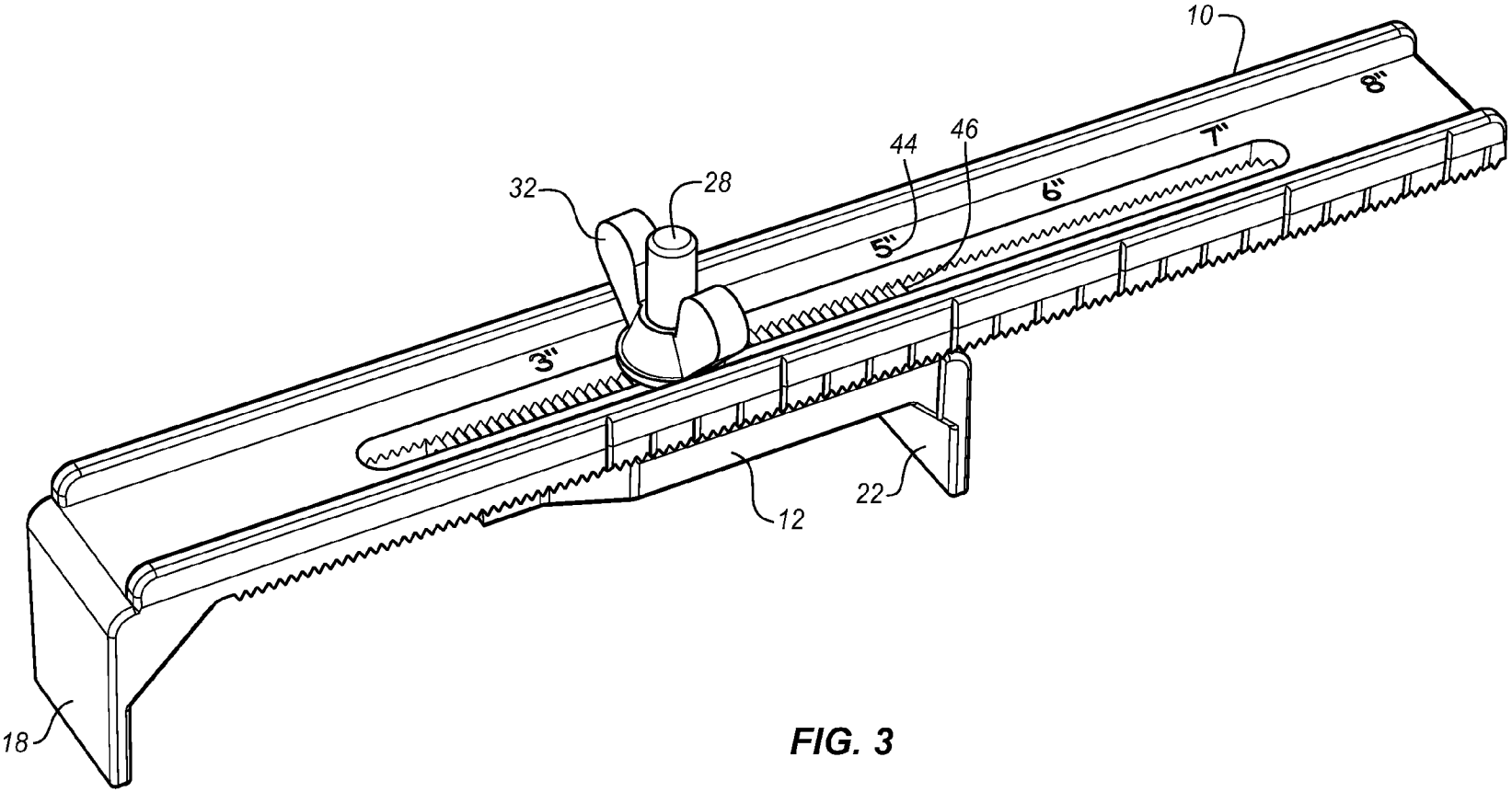
FIG. 3 is a perspective view of the back side of the adjustable tile spacer of FIG. 1 according to an embodiment of the invention.

FIG. 3 is a perspective view of the back side of the adjustable tile spacer as compared to the front side view of FIG. 1. The back side of the first support bar has a distance scale 44 indicated as inches. The smaller second support bar has an index 46, in this case the end of the bottom surface of the spacer arm. The index may alternatively be a separately engraved, stamped, marked or otherwise indicated index on the second support bar. The index mark may be aligned with any of the positions on the distance scale to allow the user to set a specific distance between the two spacer arms.

In use, an insert panel will have a particular width when placed on a wall. The adjustable tile spacer can be set to that specific width using the scale. As an example, if a particular tile mosaic decorative insert is five inches wide, then the support bar index can be moved to the five inch mark on the scale and the nut 32 tightened against the bolt 28 to lock the upper and lower spacer arms into position at that distance.

Figure 4A:
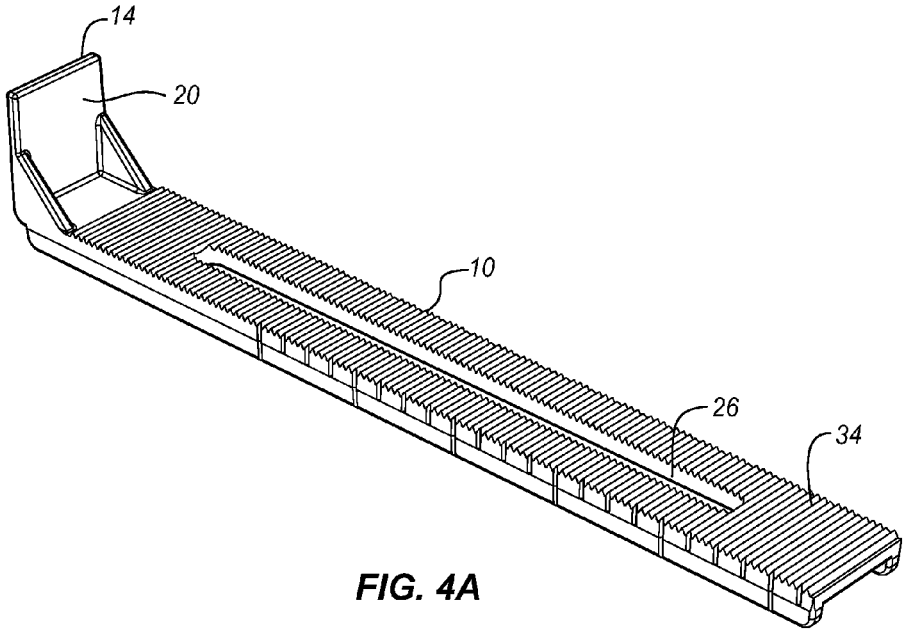
FIG. 4A is a perspective view of an elongated support bar of FIG. 1 without the other components according to an embodiment of the invention.

FIG. 4A is a perspective view of the larger elongated first support bar without the other components. The support bar 10 has a textured surface 34, such as a sequence of ribs on one side and a scale (not shown) on the other side. A spacer arm 14 at one end has a top surface 18 (not shown) and a bottom surface 20. The support bar has an elongated groove 26 along its length for attachment to the other support bar.

Figure 4B:
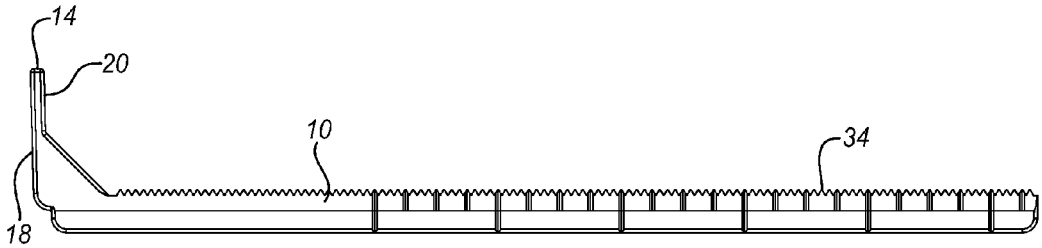
FIG. 4B is a side elevation view of the support bar of FIG. 4A according to an embodiment of the invention.

FIG. 4B is a side elevation view of the larger first support bar 10. The grooves 34 and can be clearly seen in this diagram as well as the two faces of the spacer arm.

Figure 4C:
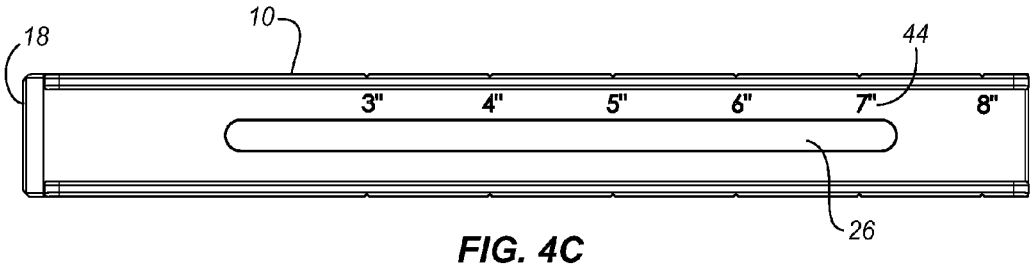
FIG. 4C is a bottom elevation view of the support bar of FIG. 4A according to an embodiment of the invention

FIG. 4C is a bottom elevation view of the first support bar in which the scale 44 can easily be seen on the bottom side of the support bar next to the groove 26. As shown in these diagrams, the spacer arm and the support bar can be formed out of a single integrated piece which may be molded, cast, machined, or stamped out of any of a variety of different materials including metals and plastics.

Figure 5A:
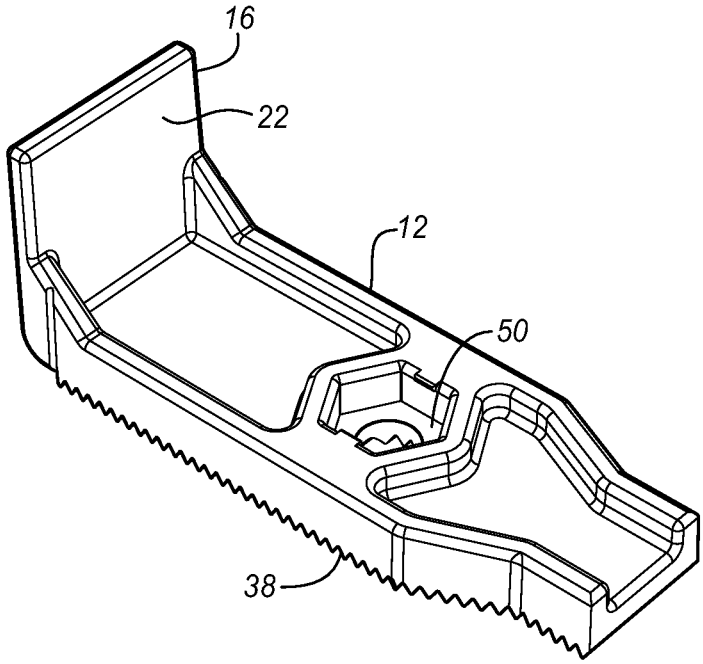
FIG. 5A is a perspective view of the other elongated support bar of FIG. 1 without other components according to an embodiment of the invention.

FIG. 5A is a perspective view of the smaller second elongated support bar 12 showing the spacer arm 16 and its top face 22. This spacer bar includes a recess 50 for holding a bolt in place and a ribbed or grooved textured surface 38 on the underside of the support bar to engage with the ribbed or grooved surface 34 of the larger first support bar. The second support bar may be shorter or longer than shown relative to the length of the first support bar. The bolt may be held by either the first or second support bar, or a different fixing system may be used, depending on the particular embodiment.

Figure 5B:
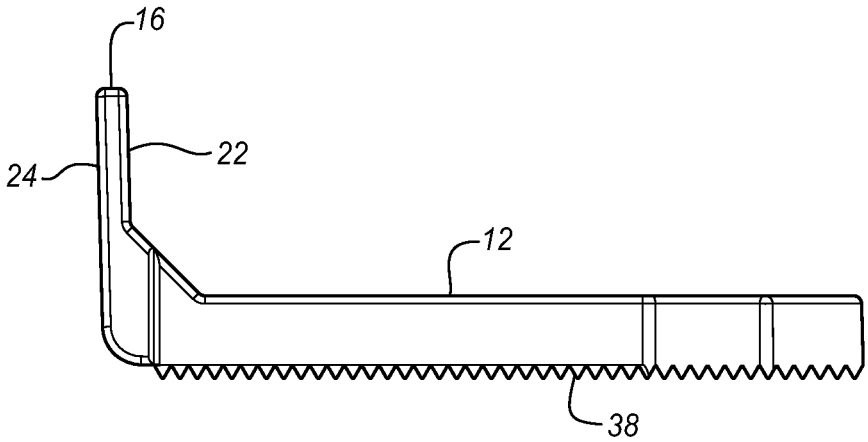
FIG. 5B is a side elevation view of the support bar of FIG. 5A according to an embodiment of the invention.

FIG. 5B is a side elevation view of the support bar 12 showing the spacer arm 16 and both the top 22 and bottom 24 surface of the spacer arm. As shown, the second support bar, like the first support bar, is also formed as a single integrated piece which may also be cast, molded, died, machined, or formed in any of a variety of other ways. Both support bars may include a variety of reinforcing braces, ribs, and other formations to increase the strength of either or both pieces.

Figure 6A:
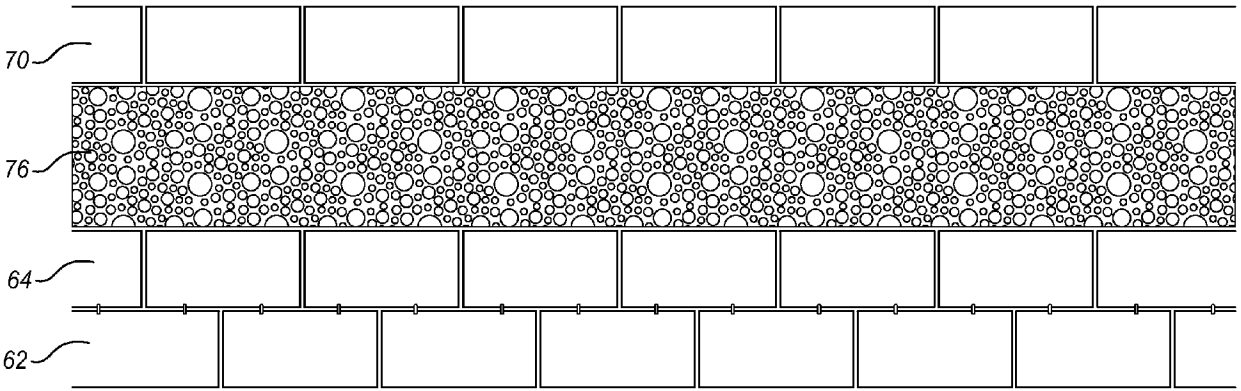
FIG. 6A is an elevation view of an example of a use of the adjustable tile spacer shown as a tile wall that is partially completed.

FIG. 6A is an elevation view of an example of a use of the adjustable tile spacer as described herein. In the example, there are two rows of lower tiles, although more or fewer may be used. Typically there are five, ten or more rows of tiles. A first row of lower tiles 62 has been applied to a vertical surface typically a wall of, for example a shower or a decorative tiled wall, of any type of room. A set of spacers 66 is placed above the first row of tiles 62. A second row of tiles 64 is then placed above the first row of tiles resting on the spacers 66.

The spacers are typically round plastic pegs which are pushed into the thinset adhesive or mortar which has already been applied to the wall to hold the tiles in place. While only two rows of tiles are shown there may be one or many rows of tiles depending upon the particular wall design to be placed a third row of tiles 70 has been placed over the adjustable tile spacers 68.

A mosaic panel 76 is inserted into the space above the lower tiles 62, 64. This space may be filed in with any type of inset which fits into the space above the lower tiles. The insert may have any desired color or pattern the array of circular tiles is provided only as an example. A third row of tiles 70 is placed against the mortar on the wall and above the mosaic 76.

Figure 6B:
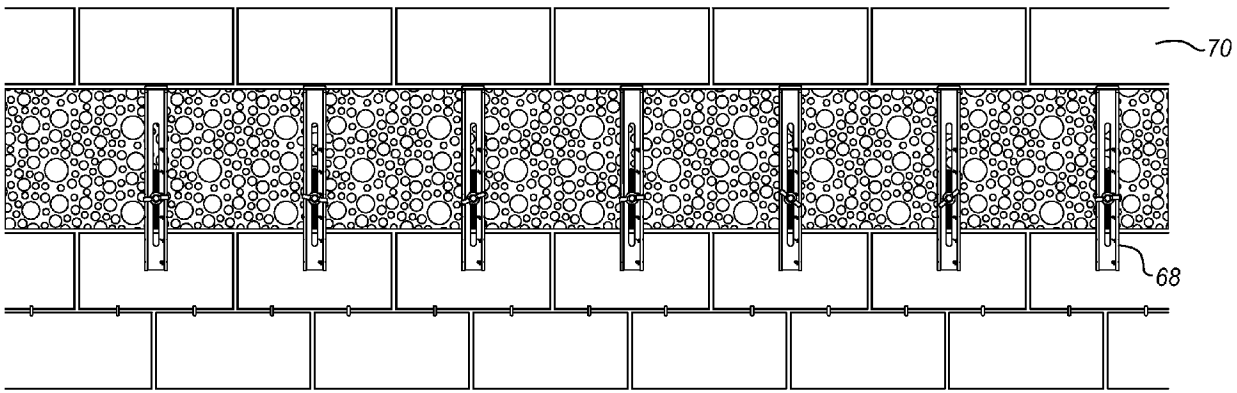
FIG. 6B is an elevation view of the tile wall of FIG. 6A supported using adjustable tile spacers according to an embodiment of the invention.

In FIG. 6B, a plurality of adjustable tile spacers 68 are placed above one of the rows of tiles, in this example the second row of tiles 64. The tile spacers are adjusted to accommodate the width of a the mosaic or decorative inset and then placed so that the bottom face of one of the support arms rests against the upper edge of a corresponding tile of the top row of tiles 64. The third row of tiles 70 is above the adjustable tile spacers 68. The third row of tiles 70 is placed against the mortar on the wall and rests on top of a top face of a support arm of the adjustable tile spacer. The adjustable spacers may be added after the tiles and the mosaic have been pressed into the mortar. The spacers may then be used to define and maintain a specific spacing between the rows. The tiles may be adjusted on the wall while the mortar is wet to abut the spacers. The spacers allow the tiles to slide against the wall into alignment along the rows.

Figure 6C:
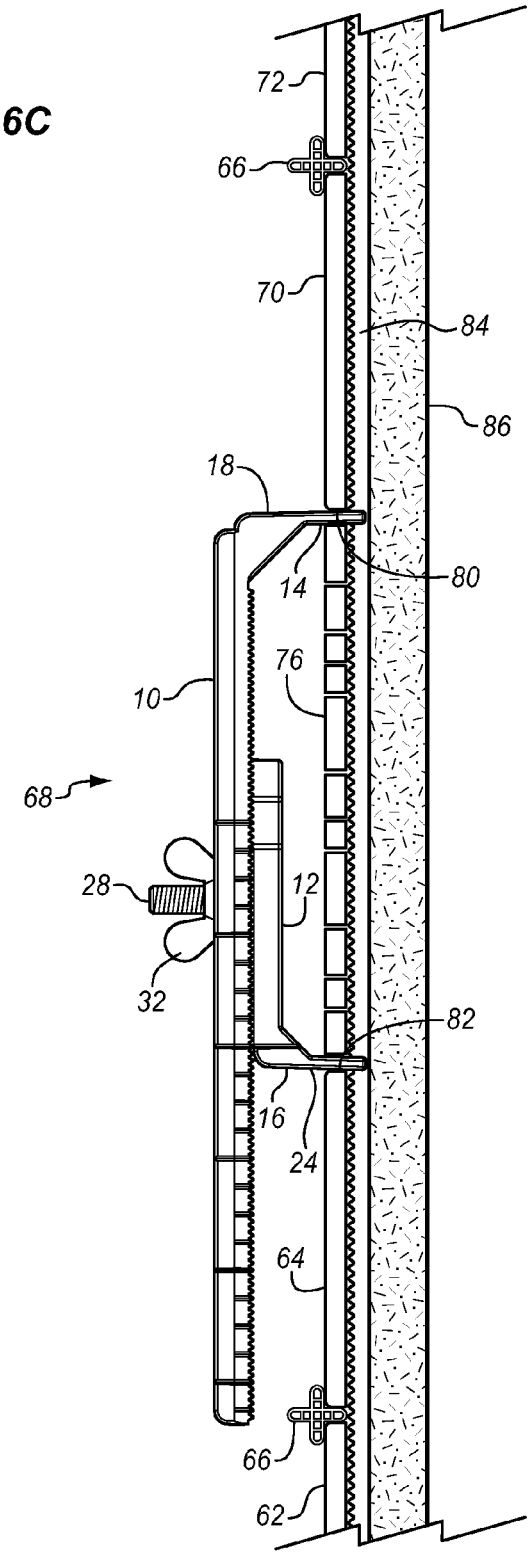
FIG. 6C is a side cross sectional view of the tile wall of FIG. 6B supported using adjustable tile spacers according to an embodiment of the invention.
Figure 6D:
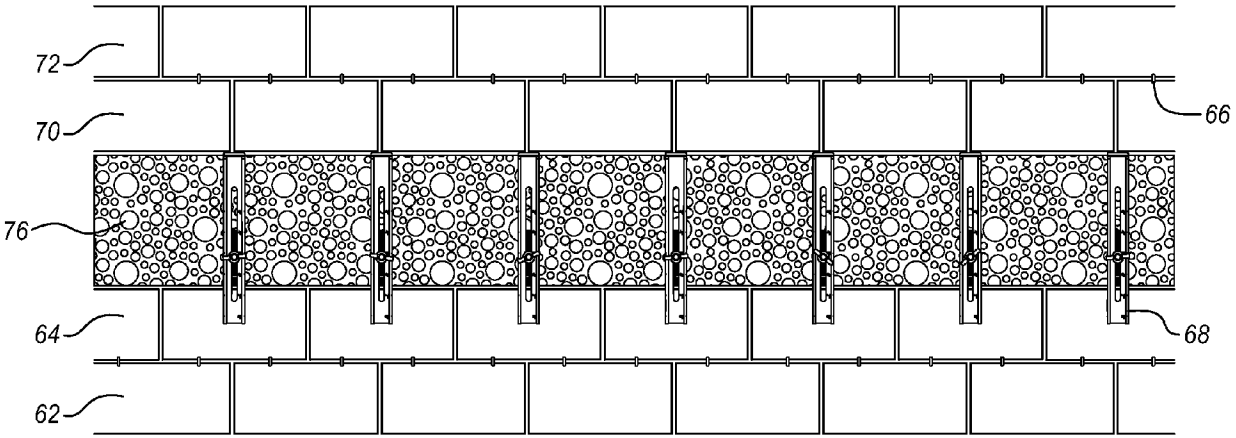
FIG. 6D is an elevation view of the tile wall of FIG. 6A before grouting and supported using adjustable tile spacers according to an embodiment of the invention.

In FIG. 6D, an additional tile row 72 has been placed above the third row. This may be done by placing conventional round spacers 66 above each of the first of the upper rows of tiles 70 and then placing the next row of tiles above the spacers 72. While only four tile rows are shown, there may be many more depending on the size of the wall, the tiles and the intended design.

FIG. 6C is a side view of a portion of the wall of FIG. 6D. There is a vertical wall 86 to which the tiles are being applied. A layer of thinset adhesive or mortar 84 is applied to the wall 86. The first and second rows of lower tiles 62, 64 are pressed against the mortar 84 and, as shown, a spacer 66 is pressed against the wall 86 against or through the mortar to set a distance between the first and second rows of tiles. The spacer 66 allows room for grout to be placed between the first and second tiles and ensures that all of the tiles of the second row are the same distance from the tiles of the first row. In addition, the tiles 64 of the second row rest upon the tiles of the first row 62. The decorative insert 76 has also been applied to the wall and pressed into the mortar.

The adjustable spacer bracket 68 is placed against the wall 86 so that the bottom face 24 of one spacer arm rests upon the top edge 82 of a tile of the top row 64 of the lower tiles. The other spacer arm 14 is also pressed against the vertical wall 86 and then the next row of tiles 70 is pressed against the mortar 84 so that the next row of tiles 70 has its weight resting upon the top face of the support arm.

As a result, the bottom edge 80 of a tile in the next row of tiles 70 presses downwards on the top face 18 of the upper support arm. This weight is transferred through the adjustable tile spacer 66 to the bottom face 24 of the lower support arm. As a result, the weight of the upper tiles 70 rests upon the lower tiles 64. The weight of the lower tiles of the top row of lower tiles 64 rests upon the spacer 66 and the lower rows of tiles 62. The space between the upper and lower spacer arms 14, 16 is then preserved for the insert that can be added later. The support arms take all of the weight of the upper tile rows 70, 72 off of the decorative insert 76 and transfer it directly to the lower tiles 62, 64.

After the thinset or mortar has dried so that the tiles are firmly held in place against the wall, all of the spacers may be removed. This includes the round pin type spacers 66 and the adjustable tile spacers 68. The result will appear as the final elevation view of FIG. 6E. In this example, there are two lower rows of tiles 62, 64 and two upper rows of tiles 70, 72 with the decorative insert 76 in between.

Figure 6E:
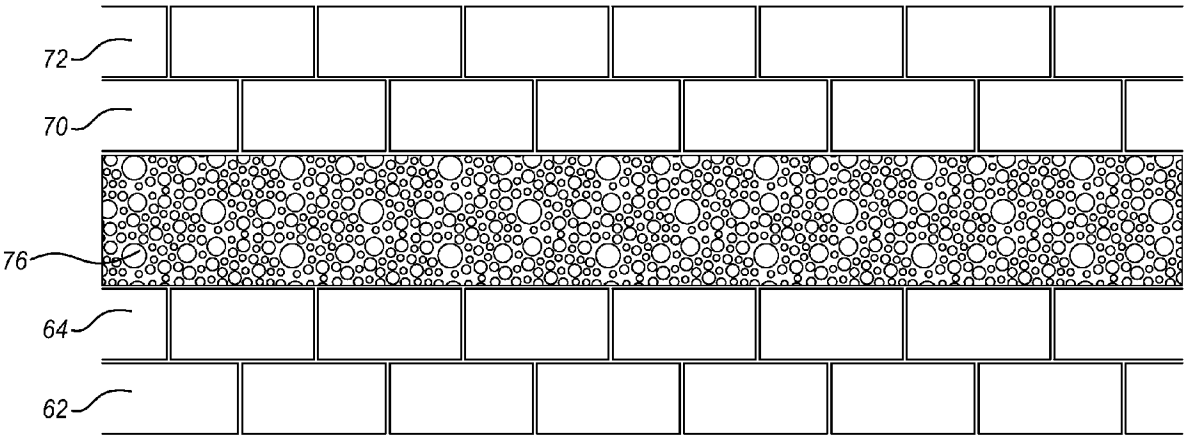
FIG. 6E is an elevation view of the tile wall of FIG. 6A after completion according to an embodiment of the invention.

In FIG. 6E the mosaic panel 76 the lower tiles 62, 64 and the upper tiles 70, can be placed at the same time. Using the spacer, all of the tiling can all be placed one after another up the wall from the bottom row 62 to the top row 72 at one time. After the mortar has dried, as in FIG. 6D, all of the spacers may be removed, and then the tiles may be grouted. This allows the entire wall installation to be made in only in two days. Traditionally, the lower tiles and the insert must be placed. Then after, these have set, the upper tiles are placed because the upper tiles cannot be allowed to rest on the decorative insert without risking squeezing the pieces of the mosaic together. If squeezed together then the next set of rows will not be straight and the decorative insert may not be flush against the wall. After the mortar has dried, then, on a third day, the grout is applied.

Alternatively, the adjustable tile spacers 68 may be placed into the wall as soon as the lower tile rows 62, 64 are set in place. The upper rows of tiles may then be placed 70, 72 using the adjustable tile spacer by resting the upper tiles against the upper arm 18 of the spacer. The insert may be installed before or after the adjustable spacer is placed on the wall. The insert may be installed before or after the mortar for the upper and lower rows of tiles has set and dried. The adjustable spacer allows much greater flexibility in how the tiles are laid up on the wall.

References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described.

While embodiments of the invention have been described in relation to a vertical installation, the same practices may be used with a horizontal installation, such as a tile or floor. The adjustable spacers can be used to ensure that straight lines are maintained even with a decorative inset that does not have consistent straight lines. While embodiments of the invention have been described in relation to the upper arm having a larger support bar than the lower arm, the support bars may be the same size or the lower support bar may be larger. The spacer may be used in the opposite orientation so that the upper spacer arm 14 is resting on a lower tile 62 and the lower support arm 16 supports an upper tile 70. The scale 44 on the back of the larger support bar may be placed on the side or front or on a different surface or on the other support bar.

While the invention has been described in terms of several embodiments, those skilled in the art will recognize that the invention is not limited to the embodiments described, and can be practiced with modification and alteration within the spirit and scope of the appended claims. The description is thus to be regarded as illustrative instead of limiting.

What is claimed is:

1. A method of laying tile on a surface comprising:

laying at least one row of lower tiles against a mortar on the surface;

adjusting a plurality of tile spacers to a distance corresponding to a height of an insert panel;

placing the tile spacers so that a bottom face of each tile spacer rests on a top edge of a respective one of the lower tiles;

laying at least one row of upper tiles against the mortar on the surface so that a bottom edge of each upper tile rests on at least a respective one of the tile spacers;

laying the insert panel between the lower and upper tiles before placing the tiles spacers;

after the mortar dries, removing the adjustable spacers.

2. The method of claim 1, wherein the surface is a vertical surface.

3. The method of claim 1, wherein the insert panel comprises tiles of different sized attached to a mesh hacking.

4. The method of claim 1, wherein each the spacer comprises:

a first support bar;

a first spacer arm connected to and extending from the first support bar, the first spacer arm having a top face to abut the vertical surface wall and support a bottom edge of an upper tile;

a second support bar connected to the first support bar and movable with respect to the first support bar to obtain the distance corresponding to the height of the insert panel;

a second spacer arm connected to and extending, from the second support bar, the first spacer arm having a bottom face to abut the vertical surface and support the second support bar against an upper edge of a lower tile;

a lock to fix the first and the second support bars in a position with respect to each other when the lock is engaged, the position determining the distance between the top face and the bottom face.

5. The method of claim 4, wherein the distance is indicated on a distance scale on one of the first and second support bars.

6. The method of claim 1, wherein the tile spacers each have a first support bar with a first textured surface and a second support bar with a second textured surface and wherein adjusting comprises adjusting a position of the first and second support bars and engaging a lock to resist movement between the first and second textured surfaces bars when the lock is engaged.

7. The method of claim 6, wherein the first and second textured surfaces comprise ribs that interlock when the lock is engaged.

8. The method of claim 6, wherein engaging a lock comprises tightening a nut and bolt to hold the first and second textured surfaces against each other.

9. The method of claim 1, wherein adjusting comprises moving a first support bar relative to a second support bar based on a scale coupled to one of the first and the second support bars to indicate a distance between a top face and a bottom face of the adjustable the spacer for different relative positions of the first and second support bars.

10. A method of laying tile on a surface comprising:

laying at least one row of lower tiles against a mortar on the surface;

adjusting a plurality of tile spacers to a distance corresponding to a height of an insert panel;

placing the tile spacers so that the bottom face of each the spacer rests on a top edge of a respective one of the lower tiles;

laying at least one row of upper tiles against the mortar on the surface so that a bottom edge of each upper the rests on at least a respective one of the tile spacers;

laying the insert panel between the lower and upper tiles, wherein the insert panel comprises tiles of different sizes attached to a mesh backing;

after the mortar dries, removing the adjustable spacers.

11. The method of claim 10, wherein laying the insert panel is performed before placing the tile spacers.

12. The method of claim 10, wherein the surface is a vertical surface.

13. The method of claim 10, wherein each tile spacer comprises:

a first support bar;

a first spacer arm connected to and extending from the first support bar, the first spacer arm having a top face to abut the vertical surface wall and support a bottom edge of an upper tile;

a second support bar connected to the first support bar and movable with respect to the first support bar to obtain the distance corresponding to the height of the insert panel;

a second spacer arm connected to and extending from the second support bar, the first spacer arm having a bottom face to abut the vertical surface and support the second support bar against an upper edge of a lower tile;

a lock to fix the first and the second support bars in a position with respect to each other when the lock is engaged, the position determining the distance between the top face and the bottom face.

14. The method of claim 10, wherein each tile spacer comprises:

a first support bar connected to and extending from a first spacer arm having a top face to abut a wall and support a tile;

a second support bar movably connected to the first support bar;

a second spacer arm connected to and extending from the second support bar, the first spacer arm having a bottom face to abut a wall and support the second support bar against a tile; and a lock to fix the first and the second support bars in a position with respect to each other when the lock is engaged to define a distance between the top face and the bottom face, the distance corresponding to a gap between two tiles; and wherein adjusting a tile spacer comprises moving the first and second support bars to a desired position and engaging the lock.

15. The method of claim 14, wherein the distance is indicated on a distance scale on one of the first and second support bars and wherein moving the first and second support arms comprises moving the first and second support arms to a position indicated on the distance scale.

16. The method of claim 14, wherein the first and second support bars are elongated parallel to each other.

17. The method of claim 16, wherein the first and second spacer arms extend perpendicular to the first and second support bars respectively.

18. The method of claim 17, wherein the second support bar is moveable with respect to the first support bar by sliding along the ridge.

19. The method of claim 17, wherein the first support bar comprises two parallel ridges and wherein the second support bar fits between the two ridges to direct the movement of the second support bar.

20. The method of claim 14, wherein the first support bar is elongated perpendicular to the first spacer arm and has a ridge parallel to the direction of the elongation and wherein the second support bar is elongated perpendicular to the second spacer arm and engages the ridge of the first support bar to maintain a parallel alignment with the first support bar.

* * * * *